US005513710A

United States Patent [19]

Kuckes

[11] Patent Number: 5,513,710

[45] Date of Patent: May 7, 1996

[54] SOLENOID GUIDE SYSTEM FOR HORIZONTAL BOREHOLES

[75] Inventor: Arthur F. Kuckes, Ithaca, N.Y.

[73] Assignee: Vector Magnetics, Inc., Ithaca, N.Y.

[21] Appl. No.: 337,188

[22] Filed: Nov. 7, 1994

[51] Int. Cl.[6] ..... E21B 7/04; E21B 47/022

[52] U.S. Cl. ..... 175/45; 175/61; 175/62; 324/326; 324/346

[58] Field of Search ..... 175/61, 62, 45; 324/346, 326

[56] References Cited

U.S. PATENT DOCUMENTS

| | | | |
|---|---|---|---|
| 2,521,745 | 9/1950 | Pope | 177/311 |
| 3,406,766 | 10/1968 | Henderson | 175/61 |
| 3,589,454 | 12/1968 | Coyne | 175/26 |
| 3,731,752 | 5/1976 | Schad | 175/45 |
| 3,853,185 | 12/1974 | Dahl et al. | 175/45 |
| 4,016,942 | 4/1977 | Wallis, Jr. et al. | 175/45 |
| 4,072,200 | 2/1978 | Morris et al. | 175/45 |
| 4,646,277 | 2/1987 | Bridges et al. | 367/191 |
| 4,710,708 | 12/1987 | Rorden et al. | 324/207 |
| 4,875,014 | 10/1989 | Roberts | 324/326 |
| 4,955,439 | 9/1990 | Kinnan | 175/45 |
| 5,002,137 | 3/1991 | Dickinson et al. | 175/45 X |
| 5,165,490 | 11/1992 | Nosaka | 175/45 |
| 5,182,516 | 1/1993 | Ward et al. | 175/45 X |
| 5,258,755 | 11/1993 | Kuckes | 175/45 X |
| 5,305,212 | 4/1994 | Kuckes | 324/346 X |
| 5,322,391 | 6/1994 | Fink | 175/73 |
| 5,363,926 | 11/1994 | Mizuno | 175/45 |

*Primary Examiner*—Hoang C. Dang
*Attorney, Agent, or Firm*—Jones, Tullar & Cooper

[57] ABSTRACT

A method and apparatus for drilling a borehole under an obstacle including placing a solenoid on the surface of the earth at the far side of the obstacle, near a preselected borehole exit location. A drilling assembly at an entry location on the near side of the obstacle is driven to produce a borehole which is directed under the obstacle toward the exit location. Initially, guidance of the drilling assembly is by conventional survey techniques, but when the borehole moves to within about 100 meters of the solenoid, the solenoid magnetic field is used to guide the drilling operation.

6 Claims, 2 Drawing Sheets

SOLENOID GUIDE SYSTEM FOR HORIZONTAL BOREHOLES

BACKGROUND OF THE INVENTION

The present invention relates, in general, to a method and apparatus for tracking and guiding the drilling of a borehole, and more particularly to tracking a borehole being drilled generally horizontally under an obstacle such as a river, stream, lake, swampy area, or the like where access to the ground above the borehole is difficult or perhaps even restricted.

Various well-known drilling techniques have been used in the placement of underground transmission lines, communication lines, pipelines or the like through or beneath obstacles of various types. In order to traverse the obstacle, the borehole must be tunnelled underneath the obstacle from an above-ground entry point to a desired exit point, with the borehole then serving to receive a casing, for example, for use as a pipeline or for receiving cables for use as power transmission lines, communication lines, or the like. In the drilling of such boreholes, it is important to maintain them on a carefully controlled track, for often the borehole must remain within a right of way as it passes under the obstacle, and its entry and exit points on opposite sides of the obstacle must often be within precisely defined areas.

Prior systems for providing guidance in the drilling of boreholes have presented problems to the user, since they require access to the earth's surface above the location of the borehole to permit placement of grids or other guidance systems on the surface of the earth, above the paths to be followed by the borehole. Often, however, access to this region is not available. Furthermore, the placement of guide cables of this kind can be extremely time consuming, and thus expensive, and accordingly an improved method of guidance has been actively sought in the art.

SUMMARY OF THE INVENTION

In accordance with the present invention, a conventional drilling tool incorporating conventional steering apparatus is utilized to drill a borehole under an obstacle such as a river, or the like. The steering apparatus in the drilling tool is responsive to control signals to direct the drill as it progresses through the earth during a boring operation. The drill tool includes a sensor which incorporates a three-axis magnetometer for detecting vector components of magnetic fields in the region of the tool and a three-axis inclinometer for detecting vector components of the earth's gravity in the region of the tool. These magnetic field components and gravity components are used to determine the location and direction of the drill with respect to a target field source. The location and direction measurements are then used to provide appropriate control signals for directing the drill as it progresses in the borehole.

The target field for guiding the directional drilling is produced by a large solenoid which incorporates a coil surrounding a large ferromagnetic core. The solenoid core may be 15 feet long and 3 inches in diameter, for example, surrounded by a coil being connected to a reversible source of direct current of sufficient magnitude to provide a direct current magnetic field in the region of the drilling tool. In a preferred form of the invention, the solenoid and power source are mounted on a vehicle such as a truck for easy transportation to a drilling site, for use in guiding the drill.

In operation, the borehole drilling equipment is placed at a location where a borehole is to be started; i.e., at the borehole entrance, or head, which may be, for example, at one side of an obstacle. The vehicle containing the target solenoid is positioned at or near the area where the borehole is to exit the ground, for example, at a side of the obstacle opposite to that of the borehole entrance. Typically, the entrance may be at or near one bank of a river, with the exit being at or near the opposite bank and the borehole passing beneath the river. Drilling the borehole is begun at the entrance site and conventional survey methods are used to guide the drill for a major part of the distance toward the exit location. As the borehole nears the desired exit site; for example, within about 100 meters, further guidance is by way of the solenoid field.

When using target field guidance, the drilling is periodically stopped and the solenoid is energized in a first direction to produce a first direct current magnetic field for a first period of time and thereafter is energized in a second direction to produce a second direct current magnetic field for second period of time. The currents are of the same magnitude and produce direct current magnetic fields in opposite directions. The solenoid magnetic field is superimposed on the Earth's magnetic field, to produce a total magnetic field which may be referred to as the apparent Earth field. The vectors of the apparent Earth field are measured by the sensor during the first and second periods. At the same time, the earth's gravity is measured to determine the orientation of the drilling assembly and the measured gravity and magnetic field vectors are then used to locate the tool with respect .to the solenoid so that control signals can be produced to direct the drill toward the exit location with greater accuracy than is available with conventional borehole directional drilling techniques. The target solenoid does not have to be at the exit location, but may be nearby, and permits guidance of the drilling tool to a selected exit location with respect to the solenoid location.

The solenoid may have a guidance range of, for example, 100 meters with a current of 5 amps producing, for example, a magnetic field of 30 nanotesla at the drilling tool sensor at this distance. Such a field is sufficient to provide accurate guidance for the drilling process. Thus, for example, when a survey is required, the drill is stopped and the sensor system in the drilling tool is activated. The direct current is caused to flow in one direction in the solenoid coil for approximately 10 seconds, and then for approximately 10 seconds in the other direction. The sensor in the drilling tool measures the x, y and z components of the total magnetic field in the region of the sensor. The electromagnetic field data for the required location determination is found by simply taking the difference between the two total magnetic field measurements with the current positive and with the current reverse. These measurements, together with down hole tool orientation measurements, are then used to determine the distance and direction from the drilling tool to the solenoid, thereby permitting accurate determination of the location of the drill with respect to the solenoid and thus of the direction in which further drilling is to be done.

BRIEF DESCRIPTION OF THE DRAWINGS

The foregoing and additional objects, features and advantages of the present invention will be apparent to those of skill in the art from a consideration of the following detailed description of a preferred embodiment thereof, taken in conjunction with the accompanying drawings, in which.

DESCRIPTION OF PREFERRED EMBODIMENT

Figure 1:
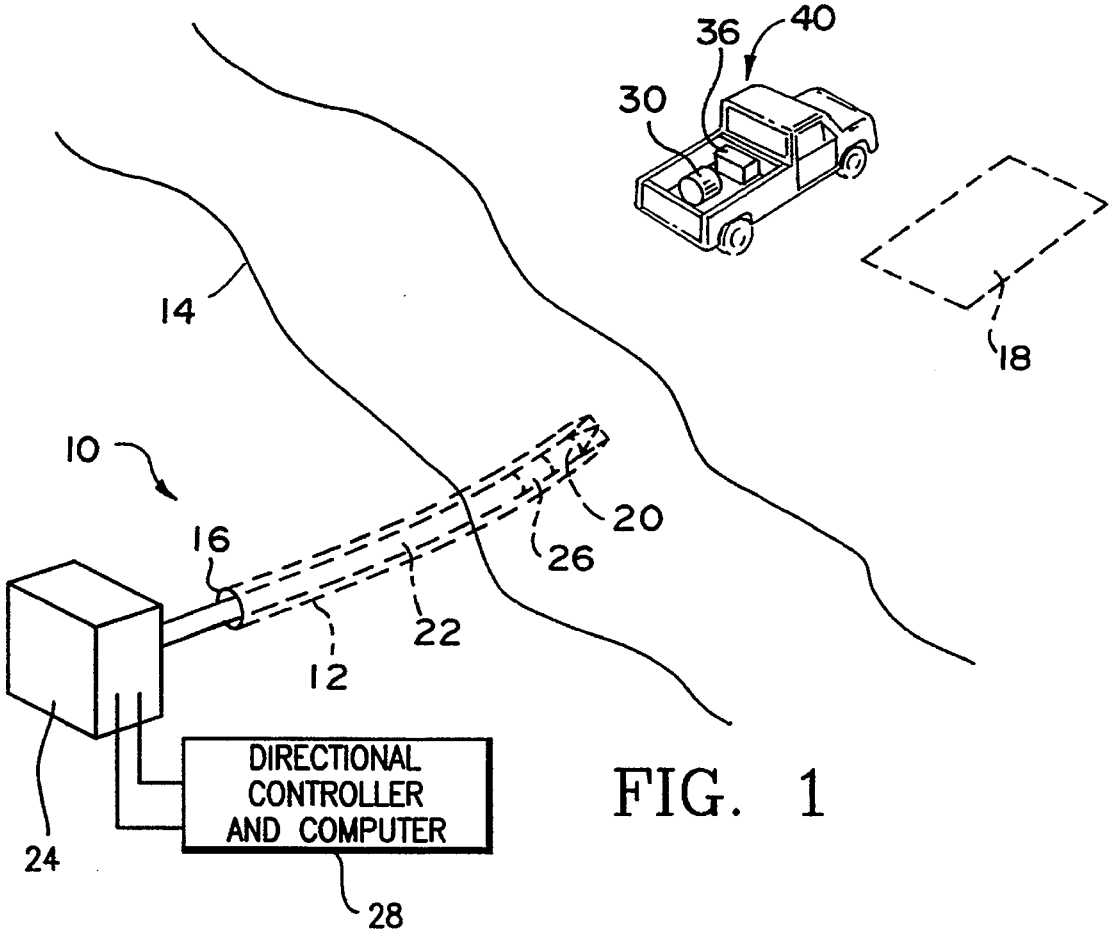
FIG. 1 is a diagrammatic illustration of a drill guidance system utilizing a direct current solenoid for guiding the drilling of a horizontal borehole under an obstacle.

FIG. 1 illustrates in diagrammatic form a directional drill assembly 10 which may be utilized to drill a borehole 12 through the earth under an obstacle such as a river or stream 14. As illustrated, the borehole enters the earth at an entry 16 on one bank of the river, and is directed to exit the earth in an exit region generally indicated by dotted lines at 18 on the opposite side of the river. It will be understood, of course, that the obstacle need not be a river, but may be a lake, a swamp, or other waterway, may be a restricted area, may be a mountain, or other area where access to the surface of the earth above the intended location of the borehole may be difficult. The borehole 12 is produced by means of a motor-driven drill 20 mounted on a drill string 22 carried by conventional surface drilling equipment generally indicated at 24. Connected between the drill 20 and the drill string 22 is a steering tool 26 which incorporates suitable instrumentation for controlling the operation of the drill motor and the direction of drill 20 in response to control signals from a directional controller 28 at the surface. The steering tool 26 preferably incorporates a three-axis magnetic field sensor 29 such as a Fluxgate magnetometer for detecting x, y and z vector components of magnetic fields in the region of the steering tool instrumentation. The magnetometer is responsive to the total magnetic field which includes not only the earth's apparent magnetic field, but magnetic fields due to anomalies in the earth, to material on the surface of the earth which might affect the magnetic field, and to a target field produced by a solenoid 30.

Figure 2:
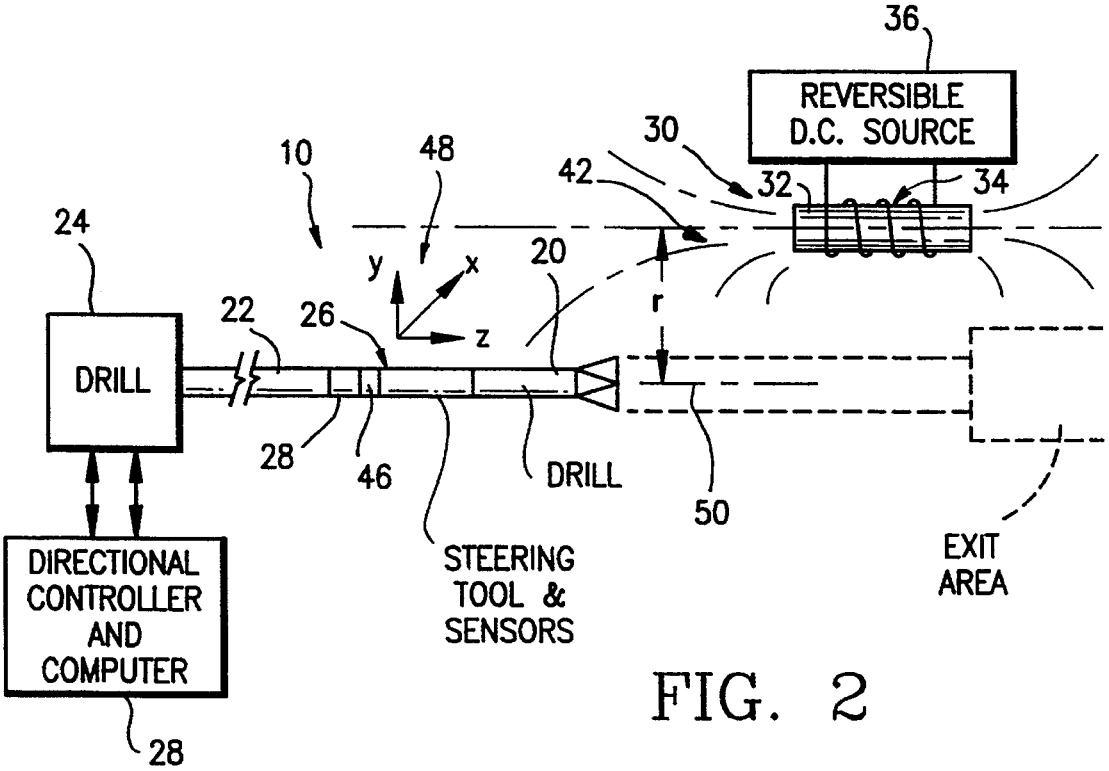
FIG. 2 is a diagrammatic illustration of the control system utilized in the system of FIG. 1.

In accordance with the present invention, solenoid 30 incorporates a ferromagnetic core 32 (see FIG. 2) surrounded by a coil 34 connected to a reversible direct current source 36. The source 36 may be a battery pack, a DC generator driven by a gasoline engine, or the like. In accordance with the invention, the solenoid 32 is mounted on a vehicle 40 for easy portability so that the system of the invention may be transported easily to any desired location. As illustrated, the solenoid core may weigh in the neighborhood of 1000 lbs., with the reversible source supplying a current of, for example, 5 amps in order to produce a point source magnetic field generally indicated at 42 in FIG. 2.

The drilling assembly 10 may also include an inclinometer 46 for measuring the x, y and z components of the earth's gravity with respect to the drilling tool. The values of the measured quantities from the magnetometer 29 and the inclinometer 46 are communicated to the drilling equipment 24 and then to the directional controller 28 by, for example, a conventional drilling fluid pressure pulse technique, the pulses being detected by the drilling equipment 24 and converted to corresponding electrical signals for use by the controller 28. These signals communicate borehole survey data to drill operators, for example by way of a computer, who may then provide directional controlling data to the drill motor for regulating the direction of drilling. The outputs from the inclinometer 46 represent the earth's gravity vector along the coordinate axes 48 illustrated for borehole 12, wherein the z-axis lies along the axis of the borehole and the y and x coordinates lie in a plane perpendicular thereto. In similar manner, the vector components of the total magnetic field measured by the magnetometer 28 are obtained for the same vector coordinates.

Whenever a measurement is made to locate the drill 20 and the direction of the borehole 12, the drilling operation is stopped and the inclinometer 46, is used to make a measurement of the gravity vector. The magnetometer is used to make two measurements of the total magnetic field, one with the current in solenoid 30 in a positive sense and the other with the current flowing in a negative sense. The earth's field components are recovered by averaging the two magnetometer measurements and the solenoid field is found by taking the difference between the two measurements.

The solenoid 30 is located at a known position with respect to the exit region 18 toward which the borehole is being drilled, and the borehole is then directed with respect to the location of the solenoid. The solenoid does not have to be located in the area 18, but may be located to one side or the other, may be located between the area 18 and the obstacle, or may be located further away from the obstacle than the area 18. In any of these cases, the direction of drilling of the borehole 12 is controlled with respect to the known location of the area 18 with respect to the solenoid so that the borehole can be directed to exit the earth at area 18.

To make a determination of the location of drill 20, the drilling motor is stopped so that the control system is stationary with its inclinometer and magnetometer at a known depth from the entry 16 and at a known angle with respect to the vertical. Before the solenoid is activated, a standard sequence of survey data measurements of the earth and gravity field is made by the sensors 29 and 46, and this data is communicated to the surface directional controller and computer 28. Thereafter, the solenoid 30 is switched on to generate a DC magnetic field 42 in one direction for a predetermined period of time and measurements are made. Thereafter the measurements are repeated with the magnetic field in the opposite direction for a predetermined period of time. If the source strength of the solenoid is known, these two data sets provide all of the necessary information to determine both distance and direction from the drill to the solenoid, and thus to the exit area 18.

Figure 3:
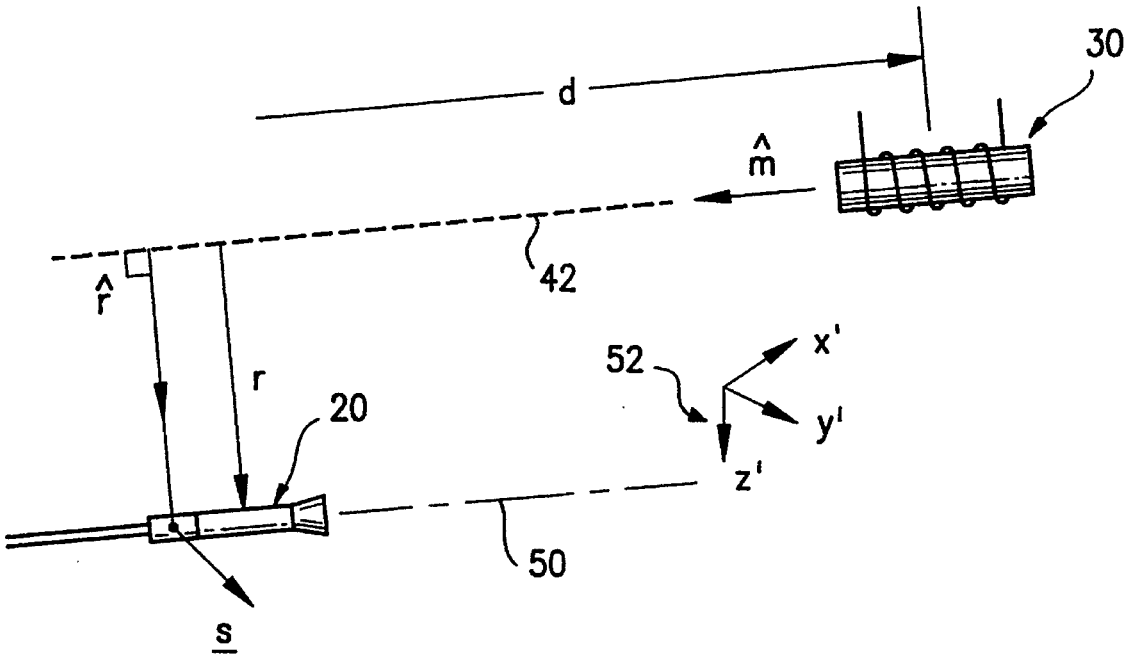
FIG. 3 is a diagrammatic illustration of the relationship of the solenoid to the location of a drill within the borehole being drilled.

Both the inclinometer 46 and the magnetometer 29 in the steering tool 26 are used for determining the direction of the borehole 12 for surveying purposes and the orientation of the tool face; i.e., the direction of the axis 50 of the drill assembly 20, for use in controlling the direction of drilling. The solenoid field vector S (FIG. 3) at the magnetometer 29 is computed in the directional controller 28 by taking the difference in the apparent Earth's field measured with positive and with negative current flow in the solenoid 30. Subtraction of these measurements gives the Earth's field, and from these measurements and the inclinometer measurements the solenoid field strength and field direction with respect to x'y'z' coordinate system 52 (FIG. 3) defined by magnetic north (x'), magnetic east (y') and the downwards vertical direction (z') can be calculated. The direction of the source solenoid $\hat{m}$ is also determined with respect to the coordinate system 52 at the same time.

The field vector S is then naturally resolved into two parts, a first part parallel to the solenoid axis $\hat{m}$ and a second part defined by a unit vector $\hat{r}$, which is a line perpendicular to the solenoid axis 42 and extending to the solenoid axis at a point P, which is the observation point. The unit vector $\hat{r}$ is formed from the measurement of the solenoid field S and the known direction of $\hat{m}$ by the vector relationship using dot products, as follows:

$$\hat{r}=\frac{\underline{S}-(\underline{S}\cdot\hat{m})\hat{m}}{\|\underline{S}-(\underline{S}\cdot\hat{m})\hat{m}\|} \quad \text{(Eq. 3)}$$

This $\hat{r}$ unit vector gives the radial direction from the solenoid axis 42 to the observation point P.

To find the radial distance $\hat{r}$ from the solenoid axis 42 to the observation point P, and to find the distance d along the solenoid axis to where the observation point P on the steering tool is located, it is convenient to decompose the solenoid field S into a part along $\hat{m}$, $S_m$ and a part along $\hat{r}$, $S_r$, as follows:

$$S_m=\hat{m}.S \quad \text{(Eq. 4)}$$

$$S_r=\hat{r}.S \quad \text{(Eq. 5)}$$

These quantities are used to determine a quantity A as follows:

$$A=\frac{3}{4(S_r/S_m)}\left(1\pm\sqrt{1+(8/9)(S_r/S_m)^2}\right)=d/r \quad \text{(Eq. 6)}$$

When the steering tool is far away; i.e., when (d/r)> 0.707, the + sign is used in the foregoing equation, and when the steering tool is near; i.e., when (d/r)< 0.707, the minus sign is used. Normally it will be obvious which value to use since one is constantly updating the location of the steering tool location as the drilling progresses. In addition, the normal surveying computer programs, which integrate the borehole direction during the course of drilling, give an approximate determination of the steering tool location, which is effectively at the drill bit.

The perpendicular radial distance r is found from the equation $$r=\left|\frac{3\,\mu_0 m}{4\pi}\;\frac{A}{S_r(1+A^2)^{5/2}}\right|^{1/3} \quad \text{(Eq. 7)}$$

where $\mu_0=4\pi10^{-7}$, and m is the solenoid source strength in amp (meters)$^2$. All distances are measured in meters. The axial distance d is found from the relationship $$d=Ar \quad \text{(Eq. 8)}$$

The solenoid 30 may also be located at a known position close to the entry region of the borehole to precisely guide the direction of drilling as well as determining the precise drill bit location for drilling the near side of the obstacle. This may be done when the near side would be out of range for a solenoid located on the far side.

Although the present invention has been described in terms of a preferred embodiment, variations and modifications may be made without departing from the true spirit and scope thereof, as defined in the following claims:

What is claimed is:

1. Apparatus for drilling a generally horizontal borehole, comprising:

a drill assembly including a drill for forming a borehole, a drill steering tool for directing the drill, an inclinometer for measuring the orientation of the drill with respect to the earth's gravity, and a magnetometer for measuring vector components of the Earth's apparent magnetic field in the region of the drill assembly;

a borehole entry at the earth's surface;

drilling equipment at said borehole entry for supporting said drill assembly in a borehole being drilled by said drill;

a controller connected to receive signals from said inclinometer and said magnetometer;

a desired borehole exit in the earth's surface at a location remote from said entry;

a solenoid at a known location with respect to said exit for said borehole;

a reversible direct current source connected to said solenoid for producing a reversible target magnetic field superimposed on the earth's magnetic field to provide said apparent Earth's magnetic field at said magnetometer; and means responsive to the measured vector components of said Earth's apparent magnetic field and to said measured orientation of said drill to determine the distance and direction from said drill assembly to said solenoid and thus to said desired borehole exit to thereby control the direction of drilling of said borehole.

2. The apparatus of claim 1, wherein said borehole entry and said desired borehole exit are on opposite sides of an obstacle.

3. The apparatus of claim 1, wherein said means responsive to said measured vector components and measured orientation is a computer.

4. The apparatus of claim 1, wherein said solenoid is transportable for location on the surface of the earth at or near said desired borehole exit.

5. The apparatus of claim 1, wherein said reversible direct current source produces a direct current in a first direction for a preselected period of time and thereafter produces a direct current in a second direction for said preselected period of time.

6. A method for drilling a generally horizontal borehole comprising:

locating drilling equipment at a borehole entry;

activating said drilling equipment to operate a drilling assembly for producing a borehole;

directing said borehole toward a preselected exit region;

locating a solenoid at a known location with respect to said preselected exit region;

periodically stopping said drilling assembly and activating said solenoid to produce a first static magnetic field in a first direction for a preselected period of time and thereafter to produce a second static magnetic field in a second direction for a preselected period of time;

measuring vector components of the Earth's apparent magnetic field, including said first and second static magnetic fields;

measuring vector components of the inclination of said drilling assembly;

determining the orientation of the drilling assembly; and determining from the orientation of the drilling assembly and the vector components of the apparent Earth's magnetic field the distance and direction from said drilling assembly to said solenoid, and thereby the distance and direction to said exit region.

* * * * *